US006238750B1

(12) United States Patent
Correll et al.

(10) Patent No.: US 6,238,750 B1
(45) Date of Patent: May 29, 2001

(54) POWDER COATING INVOLVING COMPRESSION OF THE COATING DURING CURING

(75) Inventors: Glenn D. Correll, Birdsboro; Andrew T. Daly, Sinking Spring; Jeno Muthiah, Wernersville; Paul R. Horinka, Reading, all of PA (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/415,727

(22) Filed: Oct. 12, 1999

(51) Int. Cl.[7] ..... B05D 3/06; B05D 3/12

(52) U.S. Cl. ..... 427/521; 427/195; 427/202; 427/270; 427/369; 427/370

(58) Field of Search ..... 264/293; 427/180, 427/194, 195, 202, 270, 277, 355, 356, 358, 359, 369, 320, 371, 508, 521, 522

(56) References Cited

U.S. PATENT DOCUMENTS

| | | | | |
|---|---|---|---|---|
| 4,260,066 | | 4/1981 | Hannon et al. | 215/12 R |
| 4,353,949 | * | 10/1982 | Kyminao et al. . | |
| 4,442,144 | * | 4/1984 | Pipkin . | |
| 5,051,273 | * | 9/1991 | Maeda et al. . | |
| 5,714,206 | | 2/1998 | Daly et al. | 427/475 |
| 5,721,052 | * | 2/1998 | Muthiah et al. . | |
| 5,731,043 | | 3/1998 | Morinka et al. | 427/475 |

OTHER PUBLICATIONS

U.S. application No. 08/991,475, Daly et al., filed Dec. 16, 1997.
U.S. application No. 08/964,242, Muthiah et al., filed Nov. 4, 1997.
U.S. application No. 09/075,978, Muthiah et al., filed May 11, 1998.
U.S. application No. 09/136,184, Daly et al., filed Aug. 19, 1998.
U.S. application No. 09/316,545, Muthiah et al., filed May 19, 1999.
U.S. application No. 09/191,938, Muthiah et al., filed Nov. 13, 1998.
"Decorative Overlays"; Laminating Materials Association; date unknown.
Gerosa, P.; "A Concerted Effort to Understand the Environmental Issues in the wood Finishing Industry and an Analysis of the Possible Technological Solutions"; Presented at 23rd Waterborne, High–Solids and Powder Coatings Symposium, Feb., 1996; New Orleans, LA; pp. 363–374.
"MDF From Start to Finish"; Composite Panel Association; 1995; reprinted 1997.
Morizaki, T.; No. 125:170981n; CA Selects; Coatings, Inks & Related Products; Issue 20; 1996; p. 4.
Mykytiuk, A.; "Press for Success"; FDM Furniture Design and Manufacturing; Apr. 1995; pp. 42–44, 46–48, 50–53.
"Now, roll–on Powder Coating"; Modern Plastics International; Feb. 1974.
Steed, W.; "The Ins and Outs of Vinyl Laminate"; CM&F; Feb. 1990; pp. 36, 37.
"Understanding Laminating Lingo"; FDM Furniture Design and Manufacturing; Dec., 1994; pp. 80, 82–85.
Wallace, L.R.; "Thermofused Melamine Panels Potential Application Problems"; Presented at 1992 TAPPI Plastic Laminates Short Course; Atlanta, Georgia; 1992.

* cited by examiner

*Primary Examiner*—Fred J. Parker

(57) ABSTRACT

A process of forming coatings on substrates by applying a layer of curable materials in dry powder form and then melting and curing the material is improved by compressing the layer using a flexible confining membrane. Less material is required to provide equivalent barrier protection and surface finish. The process is particularly applicable to applying dry powder coatings on temperature sensitive substrates, such as medium density fiberboard, in press apparatus, such as a membrane press, which have not commercially used dry powder coating materials previously.

58 Claims, 2 Drawing Sheets

POWDER COATING INVOLVING COMPRESSION OF THE COATING DURING CURING

BACKGROUND OF THE INVENTION

1. Field of the Invention

This invention is directed to an improved technique for coating substrates using powdered coating materials. The technique is particularly useful for coating substrates which are heat sensitive, such as cellulosic or plastic substrates. In preferred embodiments, it enables the use of powdered coating materials in manufacturing processes, such as the membrane press coating process and roll coating processes, wherein such powder coating materials have not been successfully used in the past. The invention is particularly useful for the production of coated wood articles, such as medium density fiberboard and particle board panels.

2. Description of Related Art

The application of dry coating materials on manufactured articles has become increasingly important because of their significant environmental advantage over the use of liquid coating materials, such as paints. These advantages principally involve avoiding, or minimizing, the use of volatile organic solvents, and thereby avoiding the air pollution and health concerns associated with such solvents.

Dry coating materials have generally been applied as powders or as films. Dry powder coating methods have involved depositing a dry, free flowing powder on a substrate and then heating the powder to cause it to fuse and cure. Since the heating step has generally required exposing the substrate to temperatures which cause deterioration of heat sensitive materials, such as those based on wood and/or plastic materials, the use of such dry powder coating methods has been primarily directed to coating metal articles. Recently, dry coating powder materials which are capable of fusion and curing at temperatures consistent with their use on wood based substrates have been introduced. Examples of such lower temperature coating materials are described in commonly assigned U.S. Pat. Nos. 5,714,206 and 5,721,052 and in U.S. patent applications Ser. Nos. 09/191,398 [3477-05-99] and 09/316,545. The commonly owned patents and applications referred to throughout this application are hereby incorporated by reference in this application. While these dry coating methods and materials have produced excellent textured coatings on wood based substrates, it has been difficult to produce smooth high gloss coatings with these methods and materials. Moreover, relatively thick coatings, approximately 5 mils thick, have been required to provide coatings with good moisture resistance and other barrier properties.

Membrane pressing is an important commercial process for laminating sheets on composite wood panels, such as medium density fiberboard (MDF) panels. The process involves vacuum forming a thermoplastic sheet on a MDF profile/substrate and activating a preapplied glue to bind the sheet to the profile. The technique is generally limited commercially to laminating vinyl sheets on relatively smooth and flat profiles, or substrates. If the profile is irregular, having grooves or other surface effects, the laminated film tends to not be uniformly bound to the profile. If the profile is not finished to a suitable degree of smoothness, surface irregularities appear through the laminated film. Moreover, the laminated film may exhibit irregularities, such as bubbles or orange peel surface texture, caused by gases trapped, or released from volatile components, between the sheet and the profile. A further problem occurs when localized bonding defects result in delamination, or peeling, of the film from the profile.

SUMMARY OF THE INVENTION

The present inventive coating process provides an improved coated product while minimizing or eliminating the previously noted problems. Moreover, the process permits cost savings by requiring fewer manufacturing steps, and by requiring less coating material to provide equivalent barrier protection and finish, than has been generally required in prior membrane press coating processes.

The process broadly involves providing a layer of a powder of dry curable material on a substrate, melting the powder to provide a layer of molten curable material, compressing the layer of molten material and then fully curing the compressed layer to provide a continuous cured coating on the substrate. The layer of molten material is generally compressed by a pressing means exerting pressure on the surface of the layer causing it to be compressed against the underlying substrate. It is believed that such compression of the layer causes macroscopic voids in the layer to be closed, or at least minimized, whereby comparable barrier properties of the layer, such as moisture resistance, are achieved with thinner layers. Compression of the layer also controls and/or introduces surface texture and appearance properties by appropriate selection of the surface of the pressing means. Whereas some surface finishes, such as high gloss, have only been possible with relatively thick coatings in the past, compression of the molten layer with an appropriate pressing means can provide equivalent high gloss finishes in relatively thin coatings. Thinner coating layers, of course, provide an important commercial advantage since less dry coating material and less processing time is required.

A preferred aspect of the invention involves partially curing the molten layer prior to compressing it. Partial curing increases the viscosity of the layer whereby the material is less capable of migrating from its deposited location on the substrate. This is particularly advantageous where the initially melted molten coating material is sufficiently flowable that it tends to run or be squeezed from its deposited location during the compression step.

The powder layer may be melted and, optionally, partially cured as soon as the powder is applied to the substrate. Initially, the melted curable material wets the substrate providing intimate contact capable of developing into a strong bond. The material is then partially cured to raise its viscosity sufficiently that it will not drip or otherwise migrate from its deposited location on the substrate when it is subsequently compressed. In most cases, the partial curing step does not cure the material past a condition wherein it is capable of deforming to reduce any macroscopic voids (a) at its interface with the substrate, (b) throughout the body of the layer, or (c) at its exterior surface. In those situations where modification of the surface finish or texture is the primary desired objective of the compression step, such compression may be applied at any time prior to reducing the coating temperature beneath the coating material's glass transition temperature, even if the coating is previously cured past a condition wherein it is capable of deforming to reduce voids.

The layer is then compressed against the substrate by a pressing means applied at its surface. The pressing means may be any conventional pressing device, for instance, a platen press using a pressure plate, a press using a rolling pressure plate, or opposed rolls. The process is well adapted for use with a membrane press wherein an inflatable membrane is deployed over and caused to press against the surface of the layer. Sufficient pressure is applied to cause the partially cured material to reduce any voids existing throughout its body or at its surfaces. The surface finish of the cured layer may be controlled by the pressing means, the pressing surface of which may be selected to provide a glossy, textured, matte or even an embossed surface on the coating.

Final curing of the layer may be heat activated or it may be radiation (i.e. ultraviolet or electron beam) activated. If the final curing is heat activated, portions of the required heat may be delivered by preheat stored in, and/or heating means provided in, the pressing means.

A preferred embodiment of the process employs a membrane press to form a coating on a heat sensitive substrate, such as a wood, particleboard or MDF substrate, from a dry curable powder. While membrane presses have been extensively used to form laminates of a vinyl sheet material on MDF substrates for kitchen cabinet panels and the like, they have not been successfully used to form coatings from dry powder on such substrates. The present process eliminates several process steps providing significant simplification, and corresponding cost savings, over the previous vinyl sheet membrane pressing process. In the prior process it was generally necessary to finish the substrate surface to a relatively high degree of smoothness to avoid surface irregularities showing through the applied vinyl sheet. Such is not necessary with the present dry powder process since substrate surface irregularities are filled by the dry powder and do not show through to the coating surface. The prior process required glue to bond the vinyl sheet to the substrate, which, in turn, required a glue application step. The present process does not require any glue or other adhesive to bond the coating layer to the substrate. The previous process also required a step of cutting the vinyl film and then a further finishing step of trimming the edges of the laminated panel. Neither of these steps are required in the present process. The dry coating membrane press process provides further advantages over previous membrane press processes, including excellent corner and edge coating penetration, sharp profiles, color and gloss options, rapid color changes, multiple colors in the same press cycle, no vinyl scrap, and reduced volatile organic compounds (VOC's).

The present process provides more thorough coverage, and permits greater control of surface texture and finish, all with less coating material, than was possible with previous dry coating techniques which did not provide for compression of the molten coating.

BRIEF DESCRIPTION OF THE DRAWING

A schematic of the inventive process is illustrated in FIG. 1.

DETAILED DESCRIPTION OF THE INVENTION

Figure 1:
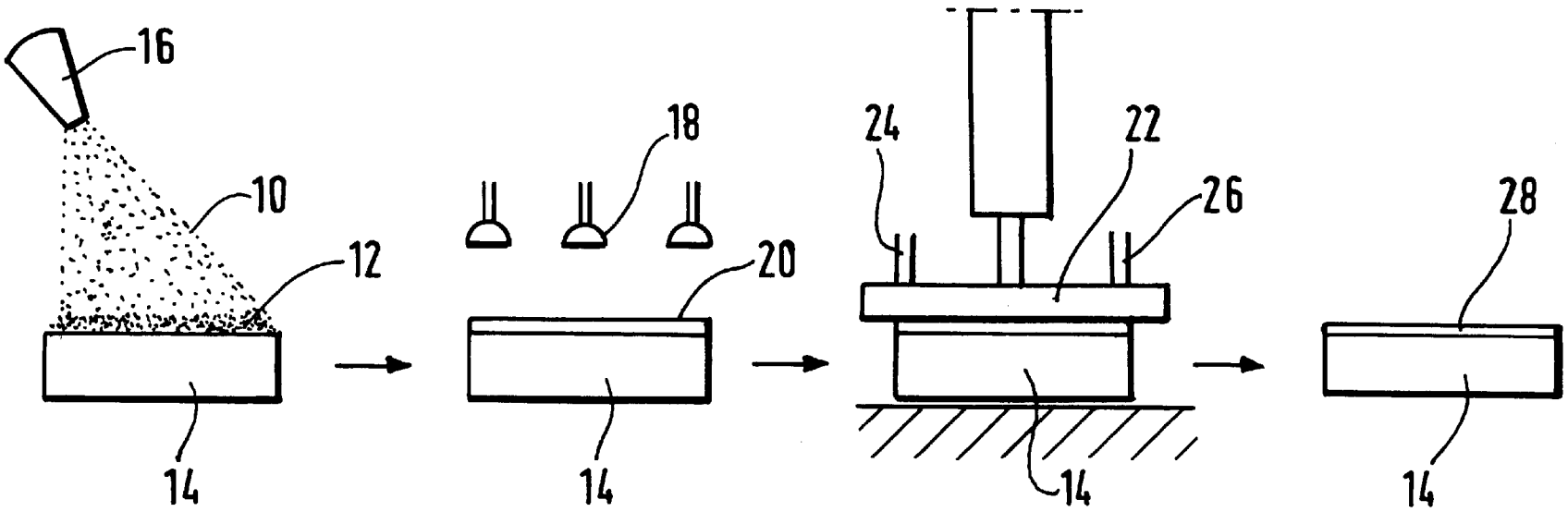

A preferred embodiment of the inventive process is schematically illustrated in FIG. 1. A dry free flowing powder of a curable material 10 is deposited as a layer 12 on substrate 14. The layer may be applied from a conventional spray nozzle 16 by conventional spray coating techniques. The deposited layer of material is then heated by an appropriate heat source, such as the illustrated heat lamps 18, to cause it to melt. The layer is then partially cured, by heat or radiation initiated curing, until it reaches a viscosity sufficient to cause the layer to resist migration during the subsequent compression step. In the illustrated embodiment, curing is initiated by the same heat source 18 used to heat the layer 20 to its melting point. The partially cured layer is then compressed against the substrate 14 by a pressing means, such as the illustrated heated pressure plate 22, pressing on its surface. The pressure applied is sufficient to force the partially cured material to reduce, preferably closing, any macroscopic voids remaining throughout its body, at its interface with the substrate, or between its surface and the pressure plate. The compressed layer of material is then fully cured. In the illustrated schematic, final curing is accomplished by heat transferred from a heat transfer fluid which is circulated through the heated pressure plate 22 through ports 24 and 26. The resulting product comprises the substrate 14 carrying a fully cured layer 28 of the curable material. The cured layer will typically be from 1 to 20 mils thick, and, preferably, is from 2 to 6 mils thick.

Figure 2:
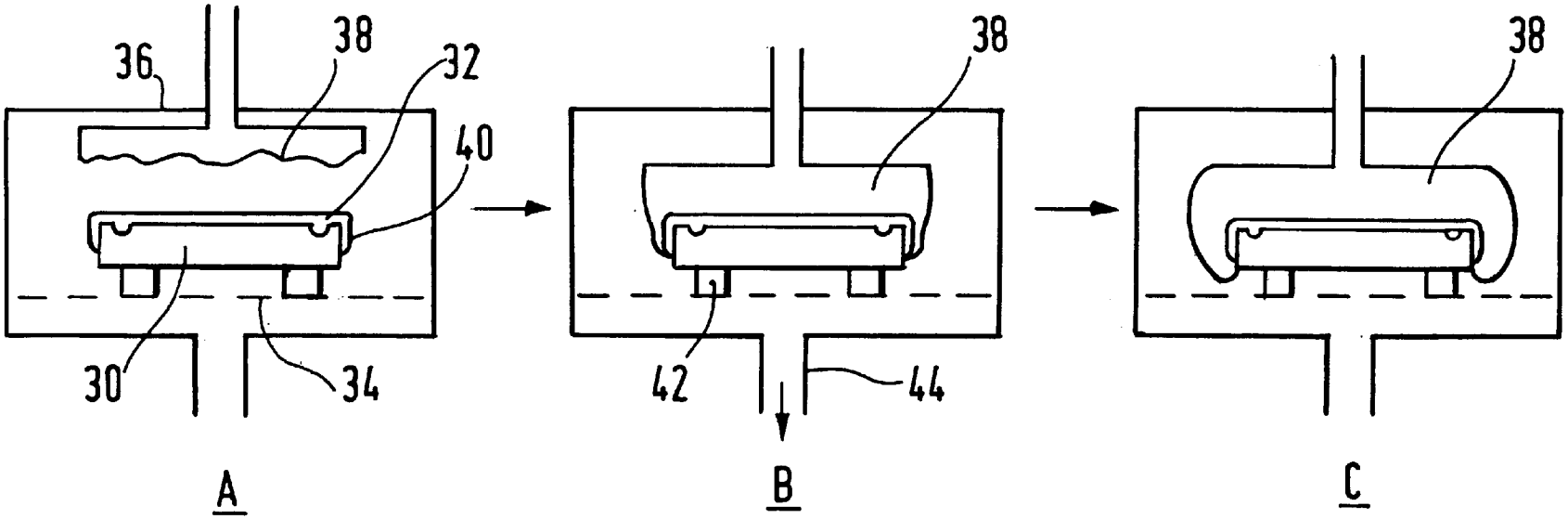
FIG. 2 schematically illustrates the inventive process conducted in a membrane press, a preferred embodiment.

A further preferred embodiment of the process which uses a membrane press to perform the compression step is schematically illustrated in FIG. 2. A substrate 30 with a deposited layer of powder of a curable material 32 on its upper surfaces is located on a grid 34 in an evacuated closed chamber 36 containing a membrane bladder 38 which is part of an inflatable structure and is adapted, when inflated, to exert pressure on the surface of the deposited layer of powder. The powder layer 32 covers the upper surface of the substrate and substantially covers the sides 40 of the substrate. The substrate is placed on pedestals 42 which maintain the substrate in a position above and separated from the grid 34. The chamber is evacuated by vacuum drawn through port 44. As illustrated at B, the membrane 38 is initially partially inflated sufficiently that the membrane contacts the surface of the powder layer and extends over the powder layer located on the sides 40 of the substrate, thereby surrounding the deposited layer 32. The powder layer is then heated sufficiently to cause it to melt and partially cure to a viscous condition. The heat necessary for melting and partial curing can be provided by preheating the substrate prior to applying the dry powder layer, and/or through the membrane from a heated fluid which is also used to pressurize/inflate the bladder. During melting and the initial partial cure of the layer, the membrane 38 is not inflated at an internal pressure which is sufficient to cause it to exert significant pressure on the layer 32. The membrane's function at this stage is simply to confine and hold the layer in position as it is melted and partially cured to a viscosity at which the layer adheres to the substrate and holds itself together without running, dripping, flowing or otherwise migrating from its position on the substrate. After the layer has partially cured to a viscosity at which it resists such migration, the pressure within the membrane bladder is increased, causing the membrane 38 to be forced against the partially cured layer 32, compressing the layer between the membrane and the substrate. The compression of the layer forces the partially cured material to reduce any voids existing within the layer and at its interfaces with either the substrate or the membrane. After the layer is compressed, it is fully cured. The final curing step can be initiated during the compression step by transferring heat to the layer from the fluid used to pressurize the membrane. Alternatively, final curing can be initiated following removal of the membrane from the compressed layer by ultraviolet or electron beam initiation or by heating with a separate heating means.

The process is suitable for applying coatings to virtually any solid substrate material. It is particularly advantageous, however, for coating temperature sensitive substrates, such as plastic or lignocellulosic containing products, with low temperature curing powders, such as those described in U.S. Pat. Nos. 5,714,206 and 5,721,052. Suitable lignocellulosic containing substrates include wood and wood composite materials, such as plywood, fiberboard, particleboard, hardboard, cardboard, etc. The process is particularly well suited for coating medium density fiberboard (MDF). Generally lignocellulosic containing products having a moisture content in the range of 3 to 10% are suitable. Effective coatings can be formed on substrates which are low in moisture content, or otherwise have a relatively low electrical conductivity, by providing a precoat of a relatively thin conductive liquid coating composition which is thermally or UV cured prior to application of the dry powder layer.

The dry powder curable materials particularly useful for coating temperature sensitive substrates by this process have relatively low melting temperatures (as low as 150° F.), and are either cured by radiation activation or have low curing temperatures (less than 350° F., preferably between 180° F. and 300° F.). The family of dry coating powders sold under the tradename LAMINEER™, by Morton International, Inc., are particularly preferred. The dry coating powders generally include a resin and a curing agent. Polyester, epoxy and polyacrylic resins are suitable. As more fully described in the incorporated U.S. Pat. Nos. 5,714,206 and 5,721,052, the powders can include a mixture of an epoxy resin with a catalytic curing agent, such as an imidazole compound or adduct, and/or a low temperature curing agent, such as an epoxy adduct of a polyamine. As more fully described in commonly assigned U.S. patent application Ser. No. 09/136,184 [3612-05-00], the curing agent may comprise a radiation activated free radical initiating curing agent, such as a phosphine oxide, phenyl ketone or a benzophenone. The curable material may also comprise both a radiation activated curing agent and a thermal initiator, as more fully described in commonly assigned U.S. patent application Ser. No. 08/991,475 [3229-05-24]. Additionally, the powder may contain flow control agents, pigments, fillers, extenders, brighteners, texturizing agents, slip additives, mold release agents and other additives generally recognized to be useful in coating compositions. The powder generally has a particle size which allows it to pass a 100 mesh screen. A finer particle size, such as powder which passes a 200 mesh screen, is preferred when it is important to minimize the amount of coating material required.

The layer of powder can be provided by any conventional method of forming a dry powder layer. We have found that an even layer of the powder on substrates which have a profiled surface (i.e., are not flat, for instance, having grooves or bas-relief designs) is best accomplished by dry spraying techniques which induce an electrical charge on the particles, such as electrostatic or triboelectric spraying. The layer may be applied at virtually any thickness. Generally, of course, the thinner the layer that provides the required protection and aesthetic appearance, the more economical is the coated product. While different powder compositions have different characteristics, we find that adequate appearance and physical properties are generally achieved with dry powder layers 1 to 20 mils thick, and that layers 2 to 6 mils thick usually provide very satisfactory coatings. In contrast, when vinyl films are applied to fiberboard substrates by prior membrane press processing techniques, 6–15 mil films are typically used for textured finish coatings and 20–40 mil films are typically used for smooth or glossy finish coatings.

It is beneficial to confine the deposited layer until after the layer has been partially cured. Generally, confining the deposited layer is indicated when the melted curable material has a very low viscosity and/or the substrate is highly profiled, resulting in the molten curable material tending to run, drip, spread, puddle or otherwise migrate on the substrate surface prior to its being sufficiently cured to resist such migration. The membrane press is particularly adaptable to confining the deposited layer. As illustrated in FIG. 2, particularly at step B, the membrane may be deployed about the deposited layer sufficiently to hold it in place, or confine it, without subjecting it to substantial compressive force until after it has been partially cured. While the compression (or pressing) step generally requires the membrane to be inflated with a pressurized fluid at a pressure greater than 5 psi, the confining step is distinguished therefrom by inflating the membrane with a pressurized fluid maintained at a pressure less than 5 psi.

The powder layer can be melted at any time after it is deposited. The layer may be heated by any convenient heating source, such as resistance heaters, heat lamps, hot air, IR radiation, radio frequency or microwave. It is generally convenient to provide at least a portion of the heat requirement by preheating the substrate to a temperature in excess of 150° F. prior to depositing the powder thereon. The melting temperature is, of course, a characteristic of the particular curable dry powder used. Typically, the presently available curable dry powder coating materials are melted and cured at temperatures in the range of 180 to 300° F. Some presently available dry powder curable coating materials can be melted at temperatures below 180° F., and even as low as 150° F., however thermal curing of such materials at such low temperatures is either not possible or is very slow. Coating of a particularly temperature sensitive substrate can advantageously use low melting point dry coating materials containing suitable radiation activated initiators, such as free radical initiators, which enable electron beam or ultraviolet activation of either or both of the partial and/or final curing steps.

Partial curing of the melted layer can be initiated by raising the layer's temperature or by the application of ultraviolet or electron beam energy, depending on the initiator provided in the curable material. When the curable material includes a catalytic curing agent and/or a low temperature curing agent, partial curing is initiated and controlled by controlling the temperature and exposure time of the curable material. Typical heat activated dry powder coatings cure at temperatures in the range of about 180° to about 300° F. Melting and initiation of the partial cure in these coatings is accomplished by raising the temperature of the deposited material to a temperature in the 180° to 260° F. range. Since the curing rate increases with increasing temperature, the extent to which the melted composition is partially cured can be controlled by appropriate selection of the curing temperature and the time the melted layer is exposed to such curing temperature prior to application of the compression step. When the curable material contains an electron beam activated or an ultraviolet activated initiator, control over the extent of polymerization can be accomplished by controlling the type of initiator, the concentration of the initiator, the type and wavelength of the radiation and/or the total radiation exposure.

One preferred embodiment provides a first radiation activated initiator (such as an ultraviolet activated initiator) in a curable material which also contains an additional heat activated catalyst or low temperature curing agent and a further ingredient, such as a pigment, which absorbs the radiation used to activate the first initiator. The partial cure step is initiated by exposing the layer of curable material to UV radiation resulting in curing occurring at or near the surface of the layer. Since the UV radiation is absorbed by the additional ingredient, initiation of the curable material is greatly reduced in the interior of the layer. Accordingly, the subsequent compression step encounters a layer having a partially cured skin at its surface which restricts any migration of the layer during the compression step, and a relatively uncured core which retains more fluidity and therefore requires the application of less pressure during compression than would be required for a more uniformly partially cured layer. Following compression the layer is heated to activate the additional catalyst or curing agent causing the layer to be fully cured. While not always required, it may be advantageous to subject the deposited curable material to a reduced pressure (vacuum) prior to initiation of the partial cure in order to minimize any gas entrained in the material prior to formation of the partially cured skin.

The compression step can be performed in any apparatus capable of exerting sufficient pressure on the surface of the partially cured layer to cause it to be compressed against the substrate. This step can be practiced in conventional apparatus, such as by pressing the layer to the substrate with either a planar or a rolling pressure plate, or by passing the substrate with the layer of curable material thereon through opposed rollers. The pressing surface, i.e. the pressure plate or the roller contacting the surface of the layer, should be finished in a manner which complements the desired surface finish of the curable layer. If a glossy finish is desired, the pressing surface should have a polished surface. If a textured finish is desired, the pressing surface should have a complementary texture, such as could be developed by etching the pressing surface. A patterned surface on the cured layer could be generated by providing an engraved or etched photolithographic pattern on the pressing surface. The membrane press is particularly well suited for conducting not only the compression step, but also, the partial curing and the confining steps.

Sufficient pressure should be applied during the compression step to force the partially cured material to reduce, preferably closing, any voids which exist between the pressing surface and the substrate surface, i.e. within the body of the layer of curable material and at its interfaces with each of the pressing surface and the substrate. In any given case, the required pressure will depend on the particular curable material used in the layer, the thickness of the layer, the degree of curing resulting from the partial cure step, the temperature of the layer, the rigidity and porosity of the substrate, the desired surface texture of the product and the particular pressing means used to accomplish the compression. Generally, the applied pressure during the compression step should be greater than 5 psi. While there is no critical upper limit on the applied pressure, since greater pressures require heavier, more expensive equipment, and since there are other ways of controlling the effectiveness of the applied pressure (such as by increasing or decreasing the fluidity of the molten layer during the compression step) it should not be necessary to apply pressures in excess of about 10,000 psi. The preferred applied pressures will vary substantially depending on the particular pressing means used to accomplish the compression step; however, the preferred applied pressures are generally in the range of about 10 psi to about 5000 psi. When the compression step is performed in a membrane press, the applied pressure is generally within the range of 10 to 1400 psi, and, preferably, in the range of 50 to 750 psi.

The pressing surface may be operated cool or it may be heated and function as a source of heat for initiating the final full cure of the compressed layer. The use of a cool, or unheated, pressing surface improves the release of the compressed layer from the pressing surface, i.e. a cool surface helps reduce sticking.

The curing composition can include a mold release agent, such as zinc stearate, to enhance the release characteristics of the compressed layer from the pressing surface. The release characteristic of the compressed layer can also be enhanced by providing a release coating on the pressing surface and/or providing a more thoroughly cured "skin" at the surface of the partially cured layer, for instance, by the previously noted technique of providing a UV initiated partial cure of a layer of curable material which contains a UV absorbing pigment. When the pressing surface is the membrane of a membrane press, the material used to fabricate the membrane can also affect the release characteristic of the compressed layer. It is presently preferred that the membrane be fabricated from rubber, silicone or a polymerized fluorocarbon.

The final cure of the compressed layer can be accomplished by the same mechanisms described previously for accomplishing a partial cure. In processes which include a partial curing step prior to the compression step, the final cure may occur as a continuation of the partial cure, or it can be accomplished by activating a curing mechanism provided for in the curing composition which is different from the mechanism relied on to accomplish the partial cure. When the curing mechanism is temperature activated and requires exposure to a given curing temperature for a given period of time to accomplish full cure, the compression step can be applied at an appropriate intermediate point during the course of a single exposure to the heating means. Alternatively, as described previously, the initial partial cure can rely on radiation activation of a suitable UV or electron beam sensitive initiator in the curing composition, and the final cure can rely on temperature activation of a suitable temperature sensitive initiator in the curing composition. Alternatively, the initial partial cure can be temperature activated and the final cure radiation activated when the curable material does not include ingredients which would substantially interfere with the required activation radiation.

More than one dry powder layer may be formed on the substrate. Multiple layers of differing dry powder compositions can be provided to result in a coating which has properties attributable to each of the compositions. Special ornamental effects, such as a simulated woodgrain, can be achieved by applying multiple dry powder compositions of differing colors. Portions of the outer layer(s) are subsequently removed or displaced to expose portions of the underlying layers in the desired pattern. For instance, a coating displaying a two-tone woodgrain pattern could be fabricated by initially spraying sufficient tan colored curable dry powder to form a 2 mil thick layer, then subsequently spraying sufficient brown colored curable powder to form a 1 mil thick layer above the tan colored layer. Portions of the brown layer are subsequently removed or displaced to expose the tan layer in a pattern simulating a woodgrain. More realistic simulations are made possible by providing additional layers of curable dry powder compositions formulated in additional colors. The powder layers may be applied directly following each other, or a lower layer may be melted and possibly partially cured, prior to the application of a further outer layer. Portions of the outer layer(s) may be removed by abrading or slicing; or portions of the outer layer may be displaced as a result of being pierced or cut by a piercing point or a cutting edge. The lower layer may be formulated to be less viscous than the outer layer in order to provide a desired spreading effect upon withdrawal of a piercing point or cutting edge. Removal or displacement of the outer layer can be accomplished before, after, or during the step of compressing the molten layer. A pattern of piercing points and/or cutting edges could be incorporated in the platen of a platen press or in a roll of a roll press.

The process will generally provide a dry fully cured coating within less than ten minutes, and, preferably, within less than four minutes, from the time the dry powder is applied to the substrate. The shortest operation cycles can be achieved by using rolls to compress the applied layer and by using infrared or electron beam activated free-radical curing agents to initiate curing of the applied layer.

EXAMPLE 1

A medium density fiberboard (MDF) substrate is formed in the shape of a cabinet door with beveled edges and decorative grooves. It is then cleaned by sweeping with air jets and preheated to a surface temperature of about 180° F. A dry powder comprising a −200 mesh powder of a mixture of (a) a melt blended mixture of 70 parts of Araldite GT 7072 (a bisphenol A/epichlorohydrin epoxy resin), 30 parts of Ancamine 2014AS (an epoxy and polyamine adduct) curing agent, 5 parts Dyhard 100S (dicyandiamide) curing agent, 1.4 parts Resiflow P-67 (acrylic resin) flow additive, 0.8 parts Benzoin (2-hydroxy-1,1-diphenylethanone) flow additive, 2 parts Bentone 38 (organophilic clay) texturing agent and 30 parts TiPure R902 (titanium dioxide) pigment and (b) about 0.2% of Aluminum Oxide C, a dry flow additive, is sprayed on the preheated MDF substrate to form a layer approximately 4 mils thick. The coated MDF substrate is then located on a pedestal in a membrane press assembly having a silicone membrane, which assembly is then closed and evacuated. A heated pressurizing fluid is directed to the membrane bladder and maintained at a pressure of 2 psi, which is sufficient to cause the membrane to substantially engage the surface of the coated powder layer on the substrate. The layer is heated by supplying the pressurizing fluid at a temperature of about 300° F. The membrane is maintained at this pressure for about 30 seconds, which is sufficient to allow the powder to melt and partially cure to a thick non-running consistency, after which the pressure of the pressurizing fluid is increased to about 100 psi. At this pressure the membrane extends along and past the beveled side edge of the substrate extending a short distance beyond the back of the substrate. This pressure is maintained for about 200 seconds, which provides sufficient further heating of the compressed layer to allow the layer's composition to become fully cured. Following release of the pressure in the membrane bladder and of the vacuum in the assembly, the coated cabinet door is removed from the pedestal.

EXAMPLE 2

A further MDF cabinet door shaped substrate is coated and processed in a manner similar to the procedure explained in Example 1, however, the 100 psi pressure is only maintained for about 60 seconds. The MDF substrate with the compressed partially cured layer is removed from the membrane press assembly and the partially cured layer heated to a surface temperature of 250° F. for 5 minutes to completely cure the curable composition.

EXAMPLE 3

As reported in Table I, a series of coatings were prepared wherein one face of a particleboard (PB) or medium density fiberboard (MDF) substrate was spray coated with a dry powder comprising 70 parts Araldite GT 7072, 30 parts HT 835 (aliphatic polyamine adduct), 1.4 parts P-101 (imidazole adduct accelerator), 1.4 parts Resiflow P-67, 0.8 parts Benzoin, 2.0 parts polyethylene 6A (wax gloss reducing agent), 60.0 parts R 902 $TiO_2$, and 0.01 part UB 5005 (ultramarine tinting pigment). Each board was then assembled between rigid chrome-plated plates which were previously sprayed with a mold release agent. This assembly was then placed in a Carver platen press having platens preheated to 330° F. The press was closed and held for a hold time to allow the assembly to be heated. After the hold time, pressure was applied to the assembly and held for the designated cure time.

TABLE I

| Run No. | Substrate | Hold time | Press Pressure (psi) | Cure time (min) | Thickness (mils) |
|---|---|---|---|---|---|
| 3-2 | PB-cold | 10 min. | 5000 | 5 | 1.0–3.0 |
| 3-3 | PB-cold | till plates reach 300° F. | 2000 | 3 | 1.0–3.0 |
| 3-4 | PB-cold | 0 | 5000 | 10 | 0.4 |
| 3-5 | PB-cold | till plates reach 300° F. | 5000 | 2 | 1.5 |
| 3-6 | PB-cold | till plates reach 300° F. | 5000 | 1 | 1.2 |
| 3-7 | MDF-cold | till plates reach 300° F. | 5000 | 1 | 1.5–3.5 |
| 3-8 | PB-cold | 10 min. | 10,000 | 1/2 | 1.3 |
| 3-9 | PB-cold | till plates reach 300° F. | 5000 | 1/2 | 1.1 |
| 3-10 | PB-heated at 250° F. for 5 min. before coating | 10 min. | 5000 | 1/2 | 3.0 |

The coatings produced were generally satisfactory, however it was noted that the coating produced in Run 3-3 was not as even as the coating produced in Run 3-2. Run 3-4 was less than satisfactory because the coating material squeezed out the sides of the assembly. The coating produced in Run 3-5 had pressure seams concentrated at the edges of the board. In Run 3-6, use of a somewhat smaller particleboard substrate resulted in an even finish at the center of the board. Spraying of the coating material on a preheated particleboard substrate resulted in a thicker final finish in Run 3-10.

EXAMPLE 4

A curable material comprising a −70 mesh powder of a mixture of (a) 100 parts of a melt blended curable composition comprising approximately 72% unsaturated polyester resin, 23% pigments, 2% metal stearate and 3% organic peroxide, and (b) 10 parts of additives and pigments is sprayed to form a layer on a cold chrome-plated plate. A particleboard substrate is then placed over the powder layer and another cold chrome-plated plate placed over the particleboard to form an assembly. The assembly is placed in a Carver press which is preheated to 330° F. The assembly is then pressed at 3000 psi for 5 minutes. Particleboard containing a 1.5 mil thick coating of the cured composition is recovered when the assembly is removed from the press and the chrome plated plates removed.

EXAMPLE 5

A series of four foot by eight foot medium density fiberboard (MDF) sheets of varying thicknesses between ⅜ and 1¼ inches, are cleaned by sweeping with air jets and are preheated to a surface temperature of about 180° F. A dry powder comprising a −200 mesh size powder of a mixture of (a) a melt blended mixture of 70 parts of Araldite GT 7072 (a bisphenol A/epichlorohydrin epoxy resin), 30 parts of Ancamine 2014AS (an epoxy and polyamine adduct) curing agent, 5 parts Dyhard 100S (dicyandiamide) curing agent, 1.4 parts Resiflow P-67 (acrylic resin) flow additive, 0.8 parts Benzoin (2-hydroxy-1,1-diphenylethanone) flow additive, 2 parts Bentone 38 (organophilic clay) texturing agent and 30 parts TiPure R902 (titanium dioxide) pigment and (b) about 0.2% of Aluminum Oxide C, a dry flow additive, is sprayed on the preheated MDF substrates to form layers between approximately 1 and 5 mils thick. The coated MDF substrates are heated to various temperatures between 180° and 260° F., which are sufficient to melt the dry powder and initiate its cure. The substrates are maintained at this temperature for varying periods of time and then compressed by being passed under a compression roll. The coatings on some of the substrates are substantially fully cured prior to being passed under the compression roll, while the coatings on the remaining substrates are only partially cured prior to being compressed. The substrates having partially cured coatings are held at elevated temperatures up to 350° F. for up to ten minutes following the compression step to completely cure the coating.

EXAMPLE 6

A medium density fiberboard (MDF) substrate is formed in the shape of a cabinet door with beveled edges and decorative grooves. After being cleaned by sweeping with air jets, it is preheated to a surface temperature of about 180° F. A dry −200 mesh powder of a curable mixture is sprayed on the preheated MDF substrate to form a layer approximately 4 mils thick. The coated MDF substrate is then located on a pedestal in a membrane press assembly having a silicone membrane, which assembly is closed and evacuated. A heated pressurizing fluid is directed to the membrane bladder and maintained at a pressure of 5 psi, which is sufficient to cause the membrane to substantially engage the surface of the coated powder layer on the substrate. The layer is heated by supplying the pressurizing fluid at a temperature of about 300° F. The membrane is maintained at this pressure for about 30 seconds, which is sufficient to allow the powder to melt and partially cure to a thick non-running consistency, after which the pressure of the pressurizing fluid is increased to about 75 psi. At this pressure the membrane extends along and past the beveled side edge of the substrate extending a short distance beyond the back of the substrate. This pressure is maintained for about 30 seconds, which provides sufficient further heating of the compressed layer to allow the layer's composition to fully flow out into all geometries of the substrate. Following release of the pressure in the membrane envelope and of the vacuum in the assembly, the coated cabinet door is placed in a UV-radiation oven and exposed to sufficient ultraviolet radiation to fully cure the curable mixture providing a tough fully-cured coating having a uniform smooth appearance.

The preceding description has been provided in detail to enable workers in the art to make, practice and use the invention. Workers in the art will appreciate that modifications can be made to the described invention without departing from its spirit. Therefore, it is not intended that the scope of the invention be limited to the specific embodiments described and illustrated. Instead, it is intended that the scope of the invention be defined by the following claims and their equivalents.

We claim:

1. A process of forming a coating on a solid substrate, comprising: providing a dry, free-flowing powder of a curable material, depositing said curable material on a surface of said substrate to form a layer, heating said layer sufficiently to cause said powder to melt, compressing said layer by pressing it against said substrate by use of a flexible membrane which confines said powder until it has melted and achieved a viscosity sufficient to resist migration on the substrate surface, and fully curing said layer to form said coating on said substrate.

2. The process of claim 1, wherein said substrate includes a material which degrades when maintained at a temperature of 350° F.

3. The process of claim 1, wherein said substrate comprises lignocellulosic material.

4. The process of claim 1, wherein said curable material melts at a temperature of 180° F. or less.

5. The process of claim 1, wherein said curable material comprises a heat activated curing agent.

6. The process of claim 5, wherein said curing agent is capable of being activated by being heated to a temperature below 350° F.

7. The process of claim 1, wherein said curable material comprises an initiator capable of being activated by exposure to radiation.

8. The process of claim 7, wherein said curable material also comprises a component which is capable of absorbing said radiation.

9. The process of claim 1, wherein said curable material comprises a mold release agent.

10. The process of claim 1, wherein a second layer comprising a dry free-flowing powder of a second curable material is established over said first layer.

11. The process of claim 1, wherein said substrate is preheated to a temperature in excess of 150° F. prior to establishing said layer on its surface.

12. The process of claim 1, wherein said layer is compressed before being fully cured.

13. The process of claim 1, wherein said layer is compressed while at a temperature exceeding its glass transition temperature.

14. The process of claim 1, wherein said layer is compressed by applying a pressing means against its surface at a pressure greater than 5 psi.

15. A process of forming a coating on a solid substrate, comprising: providing a dry powder of a curable material, depositing said curable material on said solid substrate to form a layer, heating said layer sufficiently to cause said powder to melt, partially curing said layer to cause its viscosity to increase, compressing said layer by pressing it against said substrate by use of a flexible membrane which confines said powder until it has melted and achieved a viscosity sufficient to resist migration on the substrate surface, fully curing said layer to form said coating on said substrate.

16. The process of claim 15, wherein said substrate includes a material which degrades when maintained at a temperature of 350° F.

17. The process of claim 15, wherein said substrate comprises lignocellulosic material.

18. The process of claim 15, wherein said curable material melts at a temperature of 180° F. or less.

19. The process of claim 15, wherein said curable material comprises a heat activated curing agent.

20. The process of claim 19, wherein said curing agent is capable of being activated by being heated to a temperature below 350° F.

21. The process of claim 15, wherein said curable material comprises an initiator capable of being activated by exposure to radiation.

22. The process of claim 21, wherein said curable material also comprises a component which is capable of absorbing said radiation.

23. The process of claim 22, wherein said step of partially curing is initiated by exposing said layer to radiation.

24. The process of claim 15, wherein a second layer comprising a dry free-flowing powder of a second curable material is established over said layer.

25. The process of claim 24, wherein said layer and said second layer are both compressed simultaneously.

26. The process of claim 24, wherein said second curable material forms a second layer which is a different color than said layer.

27. The process of claim 15, wherein said layer is compressed by applying a pressing means against its surface at a pressure greater than 5 psi.

28. The process of claim 15, wherein said substrate is preheated to a temperature in excess of 150° F. prior to depositing said layer on its surface.

29. The process of claim 15, wherein said partial cure is initiated by exposing said layer to radiation.

30. The process of claim 15, wherein said curable material comprises a mold release agent.

31. The process of claim 15, wherein said step of partially curing said layer is initiated by heating said layer to a temperature between about 180° and 260° F.

32. The process of claim 15, wherein said step of partially curing said layer is initiated by exposing said layer to radiation.

33. The process of claim 32, wherein said step of fully curing said layer includes heating said layer to a temperature up to 350° F.

34. The process of claim 15, wherein said compression of said layer occurs after said partial curing of said layer has increased the viscosity of said layer sufficiently that the layer does not drip or otherwise migrate during the compression step.

35. A process of forming a coating on a solid substrate, comprising: providing a dry powder of a curable material, depositing said curable material on said substrate, heating said layer sufficiently to cause said powder to melt, partially curing said layer to cause its viscosity to increase, pressing a flexible membrane against the surface of said layer on said substrate, and fully curing said layer to form said coating on said substrate.

36. The process of claim 35, wherein said flexible membrane is pressed against said layer at a pressure in excess of 5 psi.

37. The process of claim 35, wherein said substrate includes a material which degrades when maintained at a temperature of 350° F.

38. The process of claim 35, wherein said substrate comprises lignocellulosic material.

39. The process of claim 35, wherein said curable material melts at a temperature of 180° F. or less.

40. The process of claim 35, wherein said curable material comprises a heat activated curing agent.

41. The process of claim 35, wherein said curing agent is capable of being activated by being heated to a temperature below 350° F.

42. The process of claim 35, wherein said curable material comprises an initiator capable of being activated by exposure to radiation.

43. The process of claim 42, wherein said curable material also comprises a component which is capable of absorbing said radiation.

44. The process of claim 35, wherein said curable material comprises a mold release agent.

45. The process of claim 35, wherein a second layer comprising a dry free-flowing powder of a second curable material is established over the layer of said curable material.

46. The process of claim 45, wherein said layer and said second layer are pressed by said flexible membrane simultaneously.

47. The process of claim 45, wherein said second curable material is a different color than said curable material.

48. The process of claim 35, wherein said substrate is preheated to a temperature in excess of 150° F. prior to establishing said layer on its surface.

49. The process of claim 35, further comprising:

confining said layer until it has melted and partially cured to a viscosity sufficient to resist migration on the substrate surface.

50. The process of claim 35, wherein said step of partially curing said molten layer is initiated by heating said layer to a temperature between about 180° F. and 260° F.

51. The process of claim 35, wherein said step of partially curing said layer is initiated by exposing said layer to radiation.

52. The process of claim 51, wherein said step of fully curing said layer includes heating said layer to a temperature up to 350° F.

53. The process of claim 35, wherein said pressing of said layer occurs after said partial curing of said layer has increased the viscosity of said layer sufficiently that the layer does not drip or otherwise migrate during said pressing.

54. The process of claim 35, wherein said flexible membrane is part of an inflatable structure, and said membrane is pressed against said layer by the pressure of a fluid supplied to the interior of said structure.

55. The process of claim 54, wherein said layer is heated by heat transferred through said membrane from said fluid.

56. The process of claim 54, wherein said membrane is pressed against said layer by supplying said fluid to the interior of said inflatable structure at a pressure in excess of 5 psi.

57. The process of claim 56, wherein fluid is initially supplied to the interior of said structure at a positive pressure less than 5 psi to confine said layer until it has melted and achieved a viscosity sufficient to resist migration on the substrate surface.

58. The process of claim 54, wherein said membrane is pressed against said layer by supplying said fluid to the interior of said inflatable structure at a pressure between 10 and 1400 psi.

* * * * *